US005499509A

United States Patent [19]

Harold et al.

[11] Patent Number: 5,499,509

[45] Date of Patent: Mar. 19, 1996

[54] NOISE CONTROL IN A CENTRIFUGAL CHILLER

[75] Inventors: Robert G. Harold, West Salem; John W. Leary, Onalaska, both of Wis.

[73] Assignee: American Standard Inc., Piscataway, N.J.

[21] Appl. No.: 291,264

[22] Filed: Aug. 16, 1994

[51] Int. Cl.[6] ..... F25B 5/00; F25B 31/00

[52] U.S. Cl. ..... 62/117; 62/505; 415/119

[58] Field of Search ..... 62/505, 296, 197, 62/117; 417/312; 415/119

[56] References Cited

U.S. PATENT DOCUMENTS

| | | | |
|---|---|---|---|
| 2,786,626 | 3/1957 | Redcay | 230/209 |
| 2,967,410 | 1/1961 | Schulze | 62/505 |
| 3,331,216 | 7/1967 | Rayner | 62/505 X |
| 3,416,330 | 12/1968 | Weller et al. | 62/505 |
| 3,931,718 | 1/1976 | Haselden | 62/505 |
| 4,419,865 | 12/1983 | Szymaszek | 62/193 |
| 4,695,224 | 9/1987 | Lown | 415/116 |

*Primary Examiner*—William E. Wayner

*Attorney, Agent, or Firm*—William J. Beres; William O'Driscoll; Peter D. Ferguson

[57] ABSTRACT

Liquid refrigerant interacts with the stream of gas flowing through in a centrifugal water chiller, downstream of the occurrence of the compression process in the compressor portion of the chiller but prior to the condensing of the gas in the chiller condenser, to reduce the acoustic energy of the gas. The noise emanating from the chiller which would otherwise result from the interaction of the discharge gas with the piping connecting the compressor portion of the chiller to the system condenser and/or with the components of the system condenser itself is thereby reduced without significantly affecting chiller performance or efficiency.

10 Claims, 3 Drawing Sheets

FIG. 3
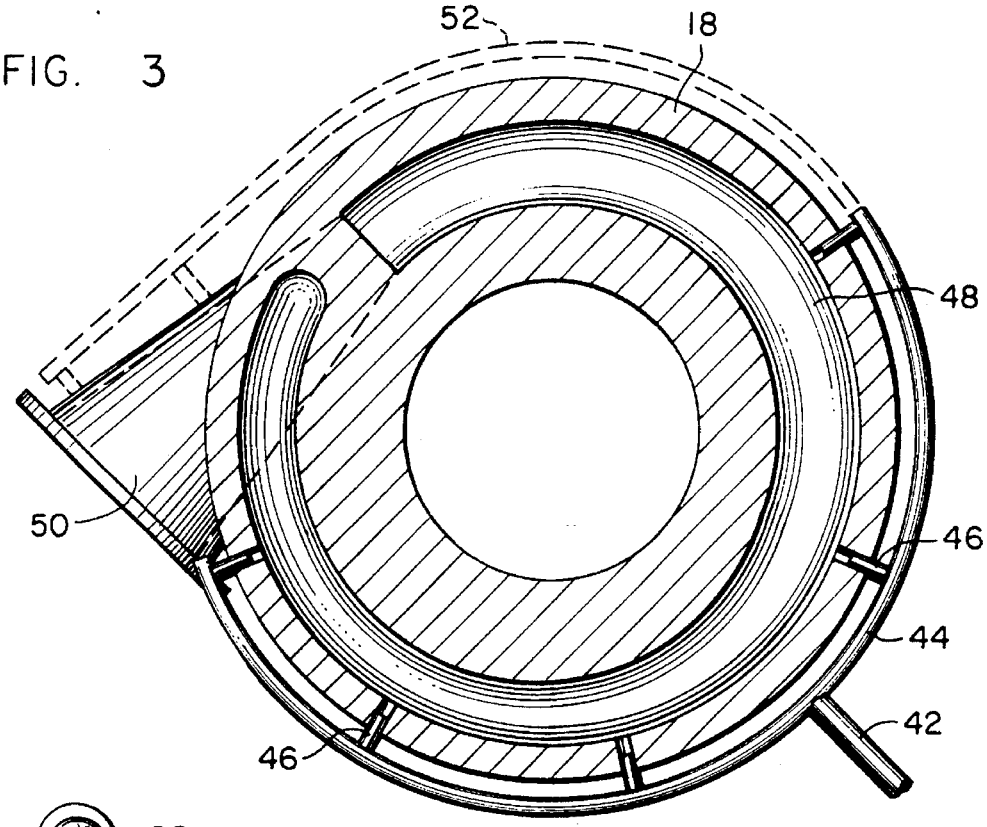
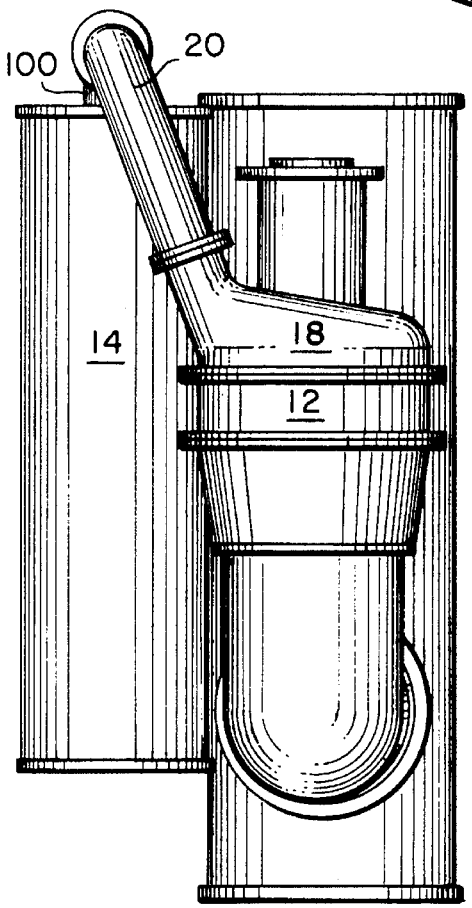
FIG. 4

NOISE CONTROL IN A CENTRIFUGAL CHILLER

BACKGROUND OF THE INVENTION

The present invention relates to refrigeration apparatus of the type generally referred to as a water chiller. With still more particularity, the present invention is directed to apparatus and a method for reducing the noise caused by refrigerant gas flow and its interaction with mechanical components in a water chiller of the centrifugal type.

Centrifugal chillers are large mechanical apparatus which in the simplest sense, are comprised of the same components as small air conditioning and refrigeration systems. In that regard they include a serially connected compressor, condenser and evaporator together with apparatus for metering refrigerant from the condenser to the evaporator. In the case of a centrifugal water chiller, a centrifugal compressor compresses refrigerant gas and discharges it to the system condenser which is typically a shell and tube heat exchanger. The acoustically energetic stream of compressed refrigerant gas delivered from the compressor to the condenser is cooled therein, typically by water supplied from a cooling tower or the local water supply. The gas condenses to liquid form in the condenser cooling process.

Once it has been condensed, the relatively high pressure system refrigerant is directed out of the condenser to a metering device where an expansion process occurs. The expansion process causes still further cooling of the system refrigerant as well as a reduction in the pressure thereof. The now relatively low pressure and much cooler system refrigerant is directed into the system evaporator where it is brought into heat exchange contact with a medium, such as water, which is chilled to a predetermined temperature by its heat exchange contact with the cooled system refrigerant. The chilled water is most typically used in a building air conditioning application or in an industrial process. System refrigerant, after having been vaporized in its heat exchange contact with the water in the evaporator, is returned to the compressor portion of the chiller where the process starts anew.

It is known both in practice and in the patent art to inject liquid refrigerant directly into the compressor portion of a centrifugal chiller at a location where system refrigerant is undergoing compression. In that regard, the existence in commercial practice of the injection of liquid refrigerant behind an impeller hub plate in a centrifugal compressor is noted as are arrangements such as those taught in U.S. Pat. Nos. 2,786,626 and 4,695,224. These patents are similar in that they both teach the injection of liquid into the multiple stages of a centrifugal compressor to achieve interstage cooling of the refrigerant undergoing compression. Such cooling of the refrigerant undergoing compression is said to improve the performance and life of the centrifugal compressor.

U.S. Pat. No. 4,419,865 teaches a screw compressor-based refrigeration system in which liquid refrigerant is directed into the line connecting the system's screw compressor to its oil separator in order to cool the mixture of oil and system refrigerant discharged from the compressor prior to its entry into the oil separator. The patent teaches that such cooling is necessary to enable the oil separator to effect the necessary, more complete separation of the relatively very large amount of oil which is carried out of screw compressors as compared to compressors of other types.

As government regulations and building owners become more demanding with respect to equipment noise levels, the need exists to quiet equipment such as centrifugal chillers to the extent possible without significantly affecting the performance or efficiency of such equipment. One source of noise in centrifugal chillers is noise which develops and is radiated by and from the chiller as the acoustically energetic, high velocity stream of refrigerant gas is discharged from the compressor portion of the chiller and is delivered to and into the system condenser where it interacts with the intervening piping and the condenser's mechanical components and structure. As such, means by which to reduce the noise associated with refrigerant gas as it passes from the compressor portion of a centrifugal chiller to and into the system condenser, without significantly affecting compressor performance and efficiency, represents an advantageous development in the centrifugal chiller art.

SUMMARY OF THE INVENTION

It is an object of the present invention to achieve noise control and reduction in a centrifugal chiller by dissipating the acoustic energy of the compressed gas discharged from the compressor portion of such chiller.

It is another object of the present invention to reduce the noise associated with the delivery of compressed refrigerant gas from the system compressor to and into the system condenser in a centrifugal water chiller in a manner which does not appreciably affect system efficiency or add significantly to the cost of the chiller apparatus.

It is a further object of the present invention to achieve noise reduction in a centrifugal chiller, with respect to the gas which is directed from the compressor portion of the chiller to the system condenser, by causing the interaction of liquid refrigerant, sourced from a remote location within the chiller, with the compressed refrigerant gas discharged from the compressor.

These and other objects of the present invention, which will be appreciated when the following Description of the Preferred Embodiment and the Drawing Figures herein are considered, are accomplished in a centrifugal chiller wherein liquefied system refrigerant is pumped from a location within the chiller, such as the system condenser, into the discharge gas flow path which connects the compressor portion of the chiller to the system condenser. The location to which liquefied system refrigerant is pumped for delivery to the compressor discharge gas flow path is downstream of the last location at which the compression of the refrigerant gas by the system compressor occurs. The injection of liquid refrigerant into the superheated discharge gas flowing to the system condenser downstream of the occurrence of the compression process in the chiller reduces the acoustic energy of the discharge gas and, therefore, the noise radiated from the chiller which would otherwise result from the interaction of the discharge gas with the downstream mechanical components of the chiller, including connecting piping, condenser walls and tubing, without affecting chiller performance or efficiency to a significant degree.

DESCRIPTION OF THE DRAWING FIGURES

FIG. 3 is a view taken along line 3—3 of FIG. 2.

FIG. 4 is a top view of an alternate embodiment of the chiller of FIGS. 1 and 2 making use of the noise quieting arrangement of FIG. 5.

DESCRIPTION OF THE PREFERRED EMBODIMENT

Figure 1:
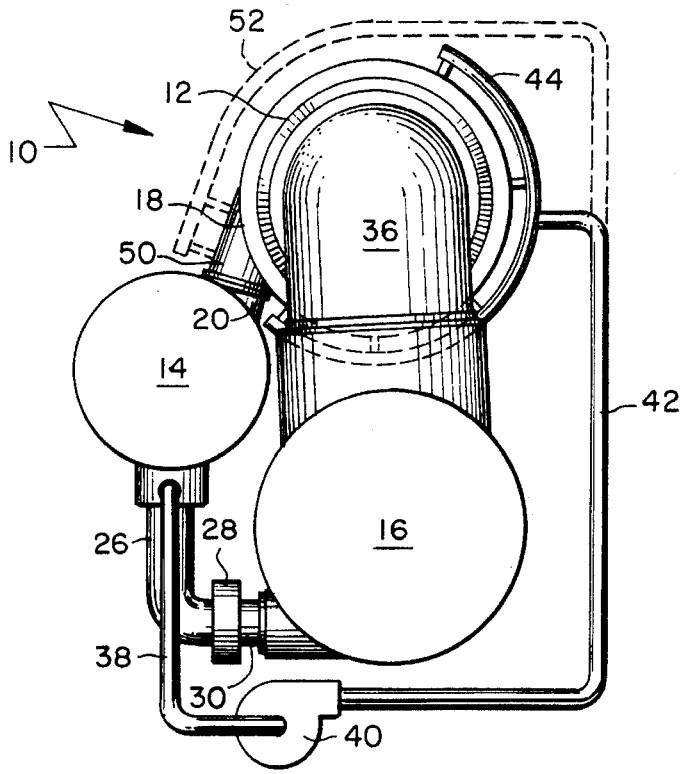
FIG. 1 shows a schematic end view of the preferred embodiment of a chiller and the chiller noise quieting arrangement of the present invention.
Figure 2:
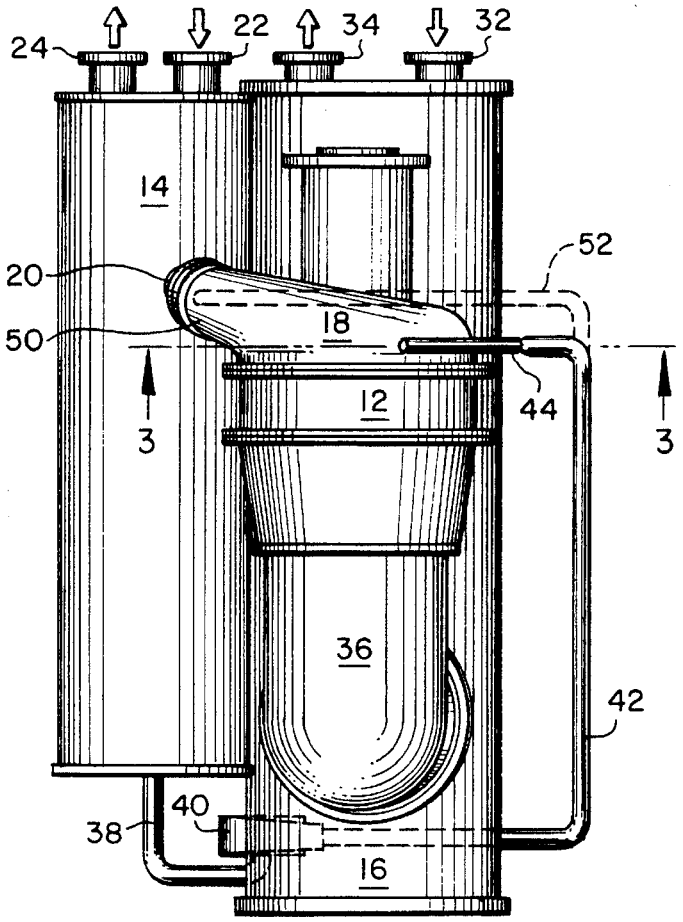
FIG. 2 is a top view of the chiller of FIG. 1.

Referring initially to Drawing FIGS. 1 and 2, a typical centrifugal chiller 10 is illustrated and is comprised of a compressor portion 12, a condenser 14 and an evaporator 16. Refrigerant gas is compressed within compressor portion 12 of chiller 10 which includes a discharge volute 18. Volute 18 will typically be a large casting affixed to the discharge end of the compressor portion of the chiller.

Acoustically energetic, high velocity compressed refrigerant gas is directed through volute 18 of compressor 12 into piping 20 which connects the compressor to condenser 14. Condenser 14 will typically be cooled by water which, for instance, enters the condenser through inlet 22 and exits through outlet 24. The water exits the condenser after having been heated in a heat exchange relationship with the compressed system refrigerant directed into the condenser from compressor portion 12 of the chiller. The heat exchange process within condenser 14 causes the relatively hot compressed refrigerant gas delivered from compressor 12 to condense and pool in the bottom of the condenser. Cooled liquid refrigerant is then directed out of condenser 14 through discharge piping 26 to a metering device 28.

The refrigerant, in passing through metering device 28, is further cooled in the process of its expansion therethrough and is next delivered through piping 30 into evaporator 16. Refrigerant passing through evaporator 16 undergoes a heat exchange relationship with a cooling medium, such as water, which enters evaporator 16 through an inlet 32 and exits, after having been cooled by the system refrigerant, through outlet 34. In the process of cooling the medium flowing through the evaporator and being heated thereby, system refrigerant vaporizes and is re-directed, as a relatively low pressure gas, from evaporator 16 through piping 36 into compressor portion 12 of the chiller.

Still referring to FIGS. 1 and 2, in the preferred embodiment of the present invention conduit 38 communicates between the lower portion of condenser 14, at a location where liquid refrigerant pools, and a pump 40. Pump 40 pumps liquid refrigerant from condenser 14 through conduit 38 and into conduit 42. Conduit 42 is connected to distribution manifold 44 which is disposed adjacent volute portion 18 of compressor 12 as will further be described. It will be appreciated that the use of other means for delivering refrigerant from condenser 14 into conduit 42 and manifold 44, such as eductors, are contemplated. Also, such liquid refrigerant could be sourced from a location downstream of the condenser.

Referring additionally now to Drawing FIG. 3, it will be appreciated that manifold 44 distributes the liquid refrigerant pumped to it by pump 40 to nozzles 46. Nozzles 46, in turn, direct liquid refrigerant into discharge passage 48 which is formed in discharge volute portion 18 of compressor 12. Discharge passage 48 of volute portion 18 is not a portion of compressor 12 in which the refrigerant compression process is ongoing but is downstream thereof and transitions into an outwardly expanding cone portion 50 through which the discharge gas passes enroute to discharge piping 20 and condenser 14. Passage 48 therefore serves to collect and direct the acoustically energetic, high velocity compressed system refrigerant, in its gaseous state, out of compressor 12 and to condenser 14 downstream of the occurrence of the compression process in the compressor.

By pumping relatively cool liquid refrigerant from the lower portion of condenser 14, or another location, into discharge passage 48 and/or cone portion 50 of volute portion 18, liquid refrigerant is caused to mix with, cool and otherwise physically interact with the highly energetic superheated refrigerant gas stream flowing out of compressor 12. Such mixing and interaction occurs upstream of the location in the system condenser where the refrigerant gas condenses but downstream of the location in the system compressor at which the compression process ends. The compression process is therefore unaffected while the acoustic energy of the discharge gas downstream of the occurrence of the compression process both enroute to and in condenser 14 is reduced. A reduction of the noise which would otherwise be generated as a result of the excitation of the piping connecting the compressor to the condenser and/or the mechanical components of the system condenser, such as its walls and tubes, by the discharge gas is thereby accomplished. In laboratory testing noise reduction on the order of 6 dBA has been demonstrated.

Still referring to Drawing FIGS. 1, 2 and 3, it will be appreciated that the injection of liquid refrigerant into the stream of gas discharged from compressor portion 12 can be into discharge passage 48 of volute portion 18 and/or cone 50 thereof and/or further downstream. In that regard, the injection of liquid refrigerant into volute cone 50 can occur and be in addition to the injection of liquid refrigerant into the upstream portion of passage 48, as is illustrated in phantom by piping 52. Additionally, but not illustrated, such liquid refrigerant injection could occur within conduit 20 which connects volute cone 50 of compressor portion 12 to condenser 14.

Figure 5:
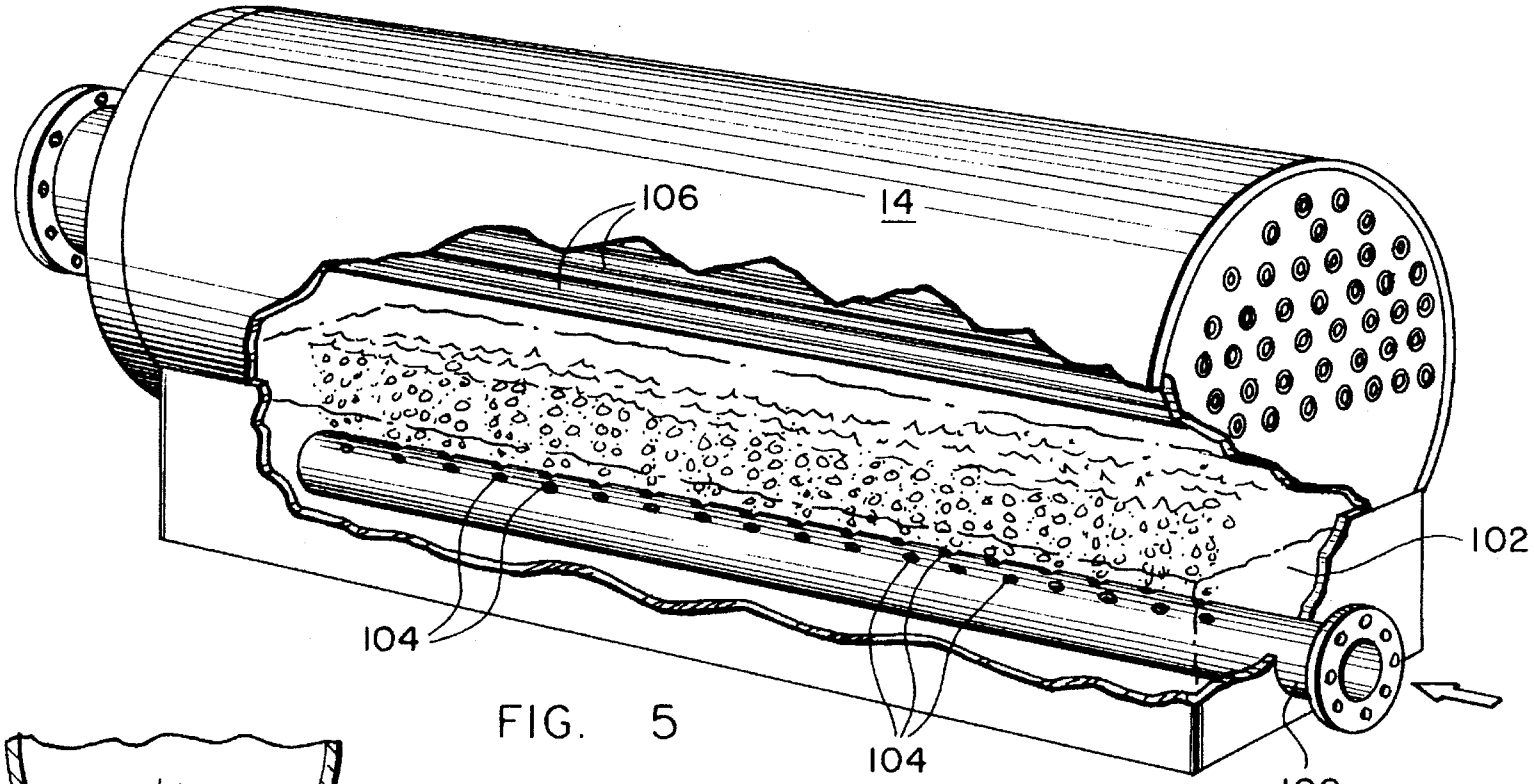
FIG. 5 is a cutaway perspective view of the system condenser of FIG. 4 illustrating an alternate embodiment of the noise quieting arrangement of the present invention.

Referring additionally now to Drawing FIGS. 4, 5 and 6, alternative embodiments of the present invention will be described. In the embodiment of FIGS. 4 and 5, conduit 38, pump 40, conduit 42, distribution conduit 34 and nozzles 46 are dispensed with and compressed refrigerant gas is directed from compressor portion 12 through piping 20 which connects the discharge volute of the compressor to condenser 14. In the FIGS. 4 and 5 embodiment, compressed discharge gas is directed out of connecting piping 20 and into condenser 14 through distribution manifold 100 which is disposed in the liquefied system refrigerant pooled in sump 102 in the lower portion of condenser 14.

Manifold 100 defines apertures 104 through which the refrigerant gas discharged from the system condenser 14 is injected into the liquid refrigerant pooled in sump 102. In this arrangement the advantage of additional and direct heat transfer between the incoming refrigerant discharge gas and the condensed system refrigerant interior of the condenser is realized. Refrigerant not directly condensed in the process rises through the liquid refrigerant in sump 102 and is condensed by its heat exchange interaction with the cooling medium flowing through tubes 106 in the upper portion of condenser 14.

Figure 6:
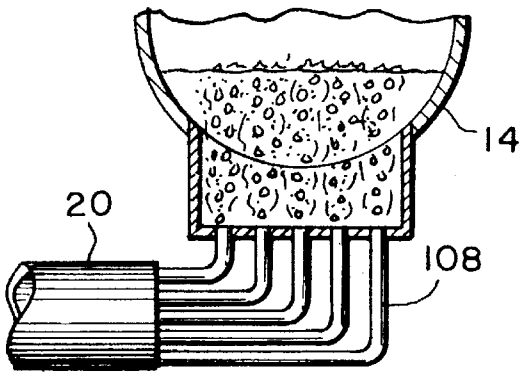
FIG. 6 is a schematic view of an alternative arrangement to the embodiment of FIGS. 4 and 5 by which to accomplish the introduction of discharge gas into the sump of a chiller system condenser to accomplish noise quieting.

Rather than employing a manifold 100, comprised of a single length of conduit disposed in the pooled refrigerant in condenser 14, it will be appreciated that multiple conduits 108 diverging from piping 20 external of the condenser, as is illustrated in FIG. 6, might be employed in order to more advantageously distribute the acoustically energetic discharge gas into the liquid refrigerant pooled in the condenser. The same could occur internal of condenser 14 through the use of branch lines (not shown) diverging from inlet piping.

The embodiments of FIGS. 4, 5 and 6 are advantageous, with respect to the embodiment of FIGS. 1, 2 and 3 in that the requirement to pump liquid refrigerant from the condenser to its point of injection into the discharge gas stream is eliminated and, once again, direct and vigorous heat transfer between the gas discharged from the system compressor and condensed system refrigerant in condenser 14 occurs. While generated noise between compressor portion 12 and condenser 14 is generally unaffected in the embodiment of FIGS. 4, 5 and 6, the introduction of discharge gas directly into the liquid sump in condenser 14 reduces the energy of discharge gas in the condenser location which is where relatively much greater noise would otherwise typically be generated due to discharge gas excitation of the condenser walls and/or tubes. The admission of discharge gas into the refrigerant sump 102 in condenser 14 and the configuration of manifold 100 will be advantageously controlled to enhance the mixing process using multiple apertures, a baffle arrangement (not shown) and/or by the distribution of discharge gas through multiple lines throughout the condenser sump as has been suggested.

While the preferred embodiment has been described in the context of a centrifugal chiller, it will be appreciated that the present invention has application in chillers of other types. Therefore, the present invention is not to be limited other by the language of the claims which follow.

What is claimed is:

1. A centrifugal chiller comprising:

a centrifugal refrigerant gas compressor, said compressor including a volute portion, said volute portion defining a passage downstream of the occurrence of the compression process in said compressor through which gas is discharged therefrom;

a condenser in flow communication with said volute portion of said compressor;

an evaporator in flow communication with said condenser and said compressor;

a device for metering refrigerant from said condenser to said evaporator; and a pump, said pump pumping liquid refrigerant from said condenser to a location in or downstream of said passage defined by said volute portion but upstream of the location in said condenser where refrigerant received from said compressor condenses so as to bring said liquid refrigerant into contact with gas compressed in said compressor.

2. The centrifugal compressor according to claim 1 wherein said discharge volute portion includes a volute cone, said volute cone defining a portion of said discharge gas passage in said volute portion.

3. The centrifugal compressor according to claim 2 wherein said pump pumps liquid refrigerant from said condenser into a portion of said discharge gas passage upstream of said portion of said passage defined by said volute cone.

4. The centrifugal compressor according to claim 2 wherein said pump pumps liquid refrigerant from said condenser into said portion of said discharge gas passage defined by said volute cone.

5. The centrifugal compressor according to claim 1 further comprising piping connecting said passage defined by said discharge volute portion of said compressor to said condenser, said pump pumping liquid refrigerant from said condenser into said piping.

6. A method of reducing noise in a water chiller comprising the step of:

compressing system refrigerant in the compressor portion of said chiller, said compression portion including a discharge volute portion which defines a passage through which compressed gas is discharged from the compressor portion;

directing compressed system refrigerant gas through and out of the discharge volute portion of the compressor to the chiller condenser; and bringing the compressed system refrigerant gas which is directed in said directing step into contact with system refrigerant in its liquid state downstream of the occurrence of the refrigerant gas compression process in the chiller compressor but upstream of the location in the chiller condenser where the compressed refrigerant gas condenses by pumping condensed system refrigerant from the chiller condenser into the gas which is so directed.

7. The method according to claim 6 wherein said pumping portion of said bringing step includes the step of pumping liquid refrigerant from the chiller system condenser into the passage defined by the discharge volute portion of the compressor.

8. The chiller according to claim 7 wherein the discharge volute portion of the compressor defines a volute cone and wherein the volute cone defines a portion of the discharge gas passage defined by the discharge volute portion of the compressor, said pumping step including the step of pumping liquid refrigerant from the chiller condenser or downstream thereof into a portion of the discharge gas passage defined by the discharge volute portion other than the portion of said passage defined by the volute cone.

9. The method according to claim 7 wherein the discharge volute portion of the compressor defines a volute cone and wherein said volute cone defines a portion of the discharge gas passage defined by the discharge volute portion of the compressor said pumping step includes the step of pumping liquid refrigerant from the chiller condenser or downstream thereof to the portion of the discharge gas passage defined by the volute cone of the discharge volute portion of the compressor.

10. The method according to claim 6 wherein the chiller includes piping connecting the passage defined by the discharge volute portion of the chiller compressor to the chiller condenser through which refrigerant directed in said directing step flows and wherein said pumping portion of said bringing step includes the step of pumping liquid refrigerant from the chiller condenser into the piping connecting the passage defined by the discharge volute portion of the chiller compressor to the chiller condenser.

* * * * *